US007204463B2

(12) United States Patent
Cheng

(10) Patent No.: US 7,204,463 B2
(45) Date of Patent: Apr. 17, 2007

(54) BALANCER DEVICE FOR HANGING ARTICLE

(76) Inventor: Ying Chi Cheng, Room 505, Wing On Plaza, 62 Mody Road, Tsim Sha Tsui East, Kowloon (HK)

( * ) Notice: Subject to any disclaimer, the term of this patent is extended or adjusted under 35 U.S.C. 154(b) by 217 days.

(21) Appl. No.: 10/407,270

(22) Filed: Apr. 7, 2003

(65) Prior Publication Data

US 2004/0197199 A1 Oct. 7, 2004

(51) Int. Cl.
*F16M 11/00* (2006.01)

(52) U.S. Cl. ..... 248/200; 248/694; 224/600; 224/610; 16/400; 446/375; 280/763.1; 416/63

(58) Field of Classification Search ..... 446/36–40, 446/256, 375, 376, 378, 97, 75, 178, 218, 446/179, 175; 434/258; 224/600, 607, 610, 224/611; 248/694, 200; 16/400; 280/763.1; 416/63

See application file for complete search history.

(56) References Cited

U.S. PATENT DOCUMENTS 152,250 A * 6/1874 Powers ..... 446/310
1,666,543 A * 4/1928 Vincent ..... 40/413
1,783,627 A * 12/1930 Raimondi ..... 446/256
2,684,213 A * 7/1954 Robert et al. ..... 244/8
3,225,982 A * 12/1965 Melton ..... 224/183
3,408,767 A * 11/1968 Gordon ..... 446/62
3,839,818 A * 10/1974 Heggedal ..... 446/62
4,581,904 A * 4/1986 Lehmann et al. ..... 63/23
5,045,012 A * 9/1991 Miller ..... 446/62
5,074,493 A * 12/1991 Greenhalgch ..... 244/3.27
5,304,035 A * 4/1994 Carter ..... 416/63
5,320,261 A * 6/1994 Andersen ..... 224/194
5,413,514 A * 5/1995 Milligan ..... 446/36
5,495,999 A * 3/1996 Cymara ..... 244/45 A
6,076,855 A * 6/2000 Webb ..... 280/765.1
6,955,524 B2 * 10/2005 Stengel ..... 416/63

* cited by examiner

*Primary Examiner*—Kimberly Wood
(74) *Attorney, Agent, or Firm*—Raymond Y. Chan; David and Raymond Patent Group

(57) ABSTRACT

A balancer device, which is adapted for incorporating with a hanging article having two sidewalls, a front side, and an opposed rear side facing towards a supporting surface, includes two balancing wings each having an inner end, and two connecting units provided at the inner ends of the balancing wings for connecting the two balancing wings on the hanging article, wherein the balancing wings are adapted to be folded at an unfolded position that the two balancing wings are arranged for outwardly extending from the two sidewalls of the hanging article in such a manner that the two balancing wings are capable of blocking a spinning movement of the hanging article with respect to the supporting surface so as to retain the front side of the hanging article in position.

8 Claims, 6 Drawing Sheets

BALANCER DEVICE FOR HANGING ARTICLE

BACKGROUND OF THE PRESENT INVENTION

1. Field of Invention

The present invention relates to a hanging article, and more particularly to a balancer device for a hanging article, which can prevent the hanging article from spinning around in a hanging manner.

2. Description of Related Arts

In order to create space for use, people would like to hang an article, having a front side, on a surface such as a clock, a lamp, or even a logo. In addition, people would like to hang a mobile phone on their bodies for fashion and/or for creating more storage space, such as pocket, to hold other items. Another example illustrates that the article is embodied as a portable fan adapted for hanging on the user's body such that the user does not have to hold the portable fan by his/her own hand.

It would be beneficial that when the article is stationary hung on the wall surface since the front side of the article can always be seen. However, when the article is hung in a non-stationary manner, such as hanging in the vehicle or on the user's body, the movement of the surface will cause the article to spin around so that the front side of the article may flip backwardly, which may lose the display purpose of the article.

SUMMARY OF THE PRESENT INVENTION

A main object of the present invention is to provide a balancer device for a hanging article, which can prevent the hanging article from spinning around in a hanging manner.

Another object of the present invention is to provide a balancer device for a hanging article hung on a supporting surface, wherein the balancer device comprises two balancing wings outwardly extended from two sides of the hanging article respectively so as to substantially block the spinning movement of the hanging article with respect to the supporting surface.

Another object of the present invention is to provide a balancer device for a hanging article, wherein the balancing wings can be selectively mounted on the hanging article by any conventional attachment so as to keep the aesthetic appearance of the hanging article.

Another object of the present invention is to provide a balancer device for a hanging article, which successfully provides an economic and efficient solution for stabilizing the hanging article in a hanging manner.

Accordingly, in order to accomplish the above objects, the present invention provides a balancer device for a hanging article having two sidewalls, a front side, and an opposed rear side facing towards a supporting surface, comprising:

two balancing wings each having an inner end; and two connecting units provided at the inner ends of the balancing wings for connecting the two balancing wings on the hanging article, wherein the balancing wings are adapted to be folded at an unfolded position that the two balancing wings are arranged for outwardly extending from the two sidewalls of the hanging article in such a manner that the two balancing wings are capable of blocking a spinning movement of the hanging article with respect to the supporting surface so as to retain the front side of the hanging article in position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
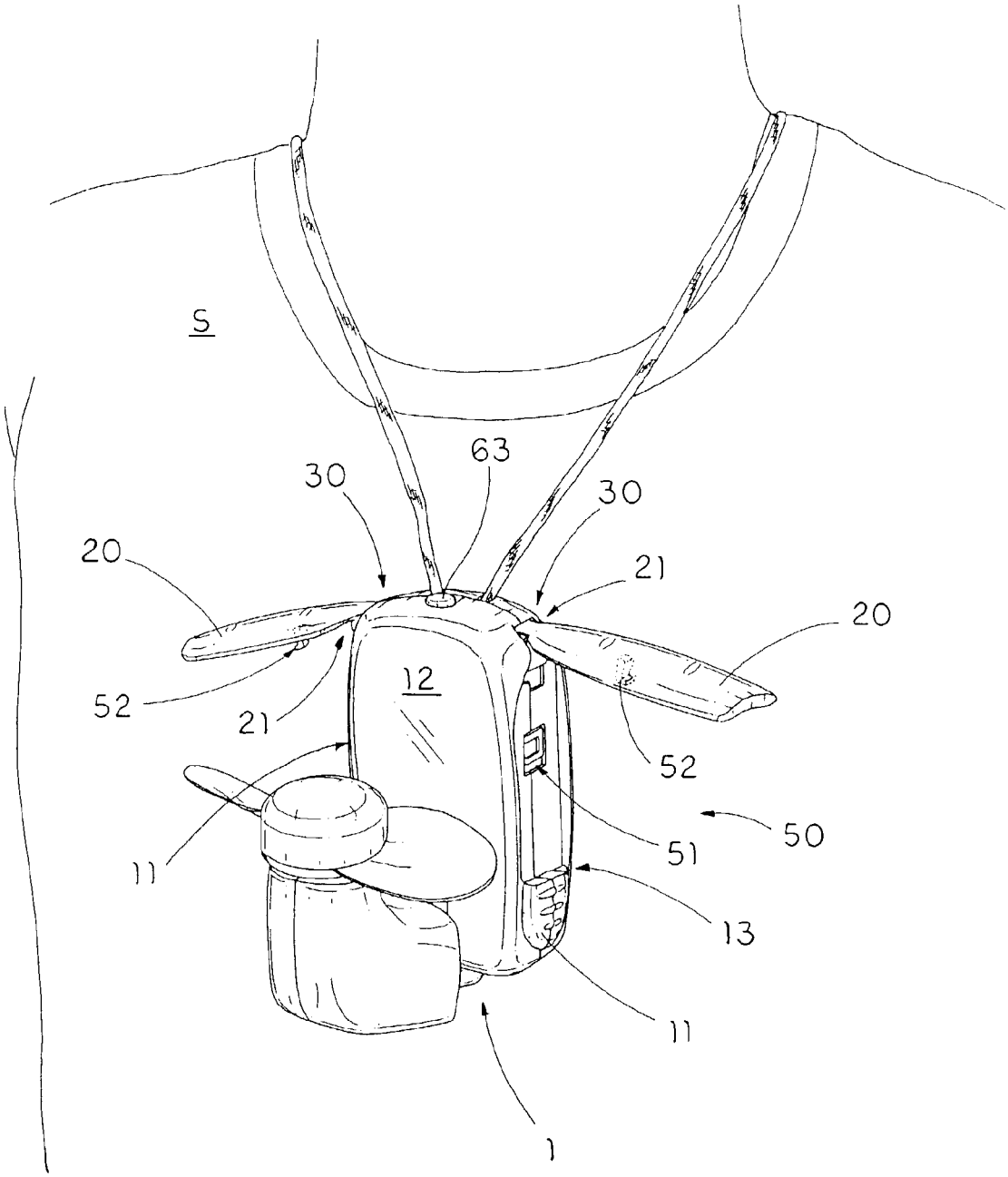
FIG. 1 is a perspective view of a balancer device for a hanging article according to a preferred embodiment of the present invention, illustrating the spinning movement of the hanging article being blocked by the balancer device.
Figure 2:
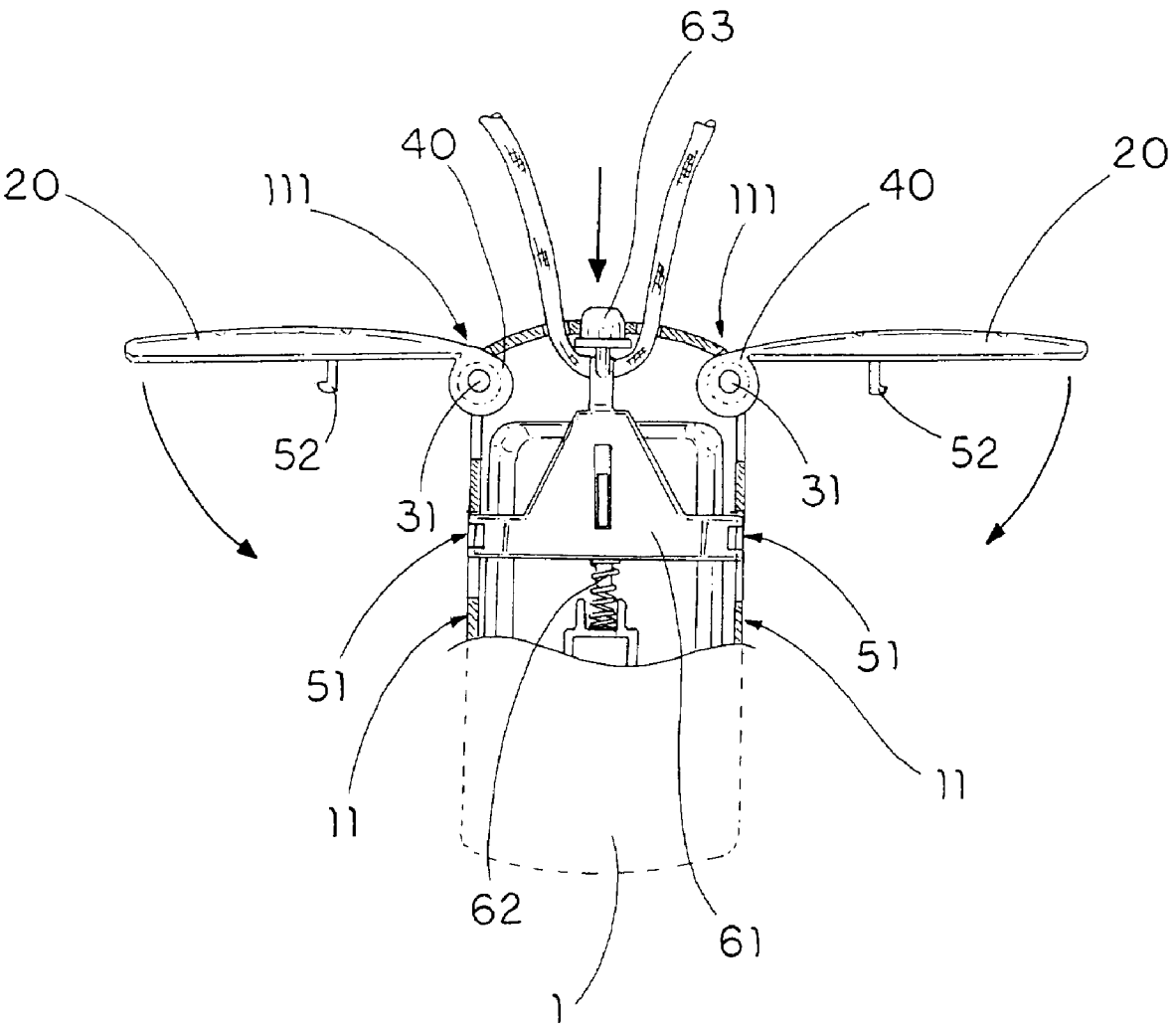
FIG. 2 is a sectional view of the hanging article incorporated with the balancer device according to the above preferred embodiment of the present invention.

Referring to FIGS. 1 and 2 of the drawings, a balancer device is adapted for incorporating with a hanging article 1 according to a preferred embodiment of the present invention is illustrated, wherein the hanging article 1 is arranged to be hung on a supporting surface S in a non-stationary manner while a spinning movement of the hanging article 1 may occur.

The hanging article 1, such as a clock timer, logo batch, fan, projector flashlight, cardholder, or ash trash, is capable of hanging on a user's body as the supporting surface S via a necklace. As shown in FIG. 1, the hanging article 1 is embodied to be a portable fan as one of the examples to mainly illustrate the user the balancer device.

The hanging article 1 has two sidewalls 11, a front side 12, and an opposed rear side 13 facing towards the supporting surface S when the hanging article 1 is hung on the supporting surface S.

The balancer device comprises two balancing wings 20 each having an inner end 21, and two connecting units 30 provided at the inner ends 21 of the balancing wings 20 for connecting the two balancing wings 20 on the hanging article 1, wherein the balancing wings 20 are adapted to be folded at an unfolded position that the two balancing wings 20 is arranged for outwardly extending from the two sidewalls 11 of the hanging article 1 in such a manner that the two balancing wings 20 are capable of blocking the spinning movement of the hanging article 1 with respect to the supporting surface S so as to retain the front side 12 of the hanging article 1 in position.

According to the preferred embodiment, the inner end 21 of each of the balancing wings 20 is extended from the respective sidewall 11 of the hanging article 1, wherein each of the balancing wings 20 is shaped corresponding to the respective sidewall 11 of the hanging article 1. Each of the balancing wings 20 has a width being not substantially exceed a width of the respective sidewall 11 of the hanging article 1. Each of the balancing wings 20 has a length being not substantially exceed a height of the respective sidewall 11 of the hanging article 1.

Accordingly, when the balancing wings 20 are outwardly extended from the sidewalls 11 of the hanging article 1, the hanging article 1 can substantially increase its width with the total length of the balancing wings 20. Therefore, when the hanging article 1 is non-stationary hung on the supporting surface S to cause the spinning movement of the hanging article 1, the two balancing wings 20 will hit the supporting surface S to block the spinning movement of the hanging article 1, so as to keep the front side 12 of the hanging article 1 at its orientated position.

Figure 3:
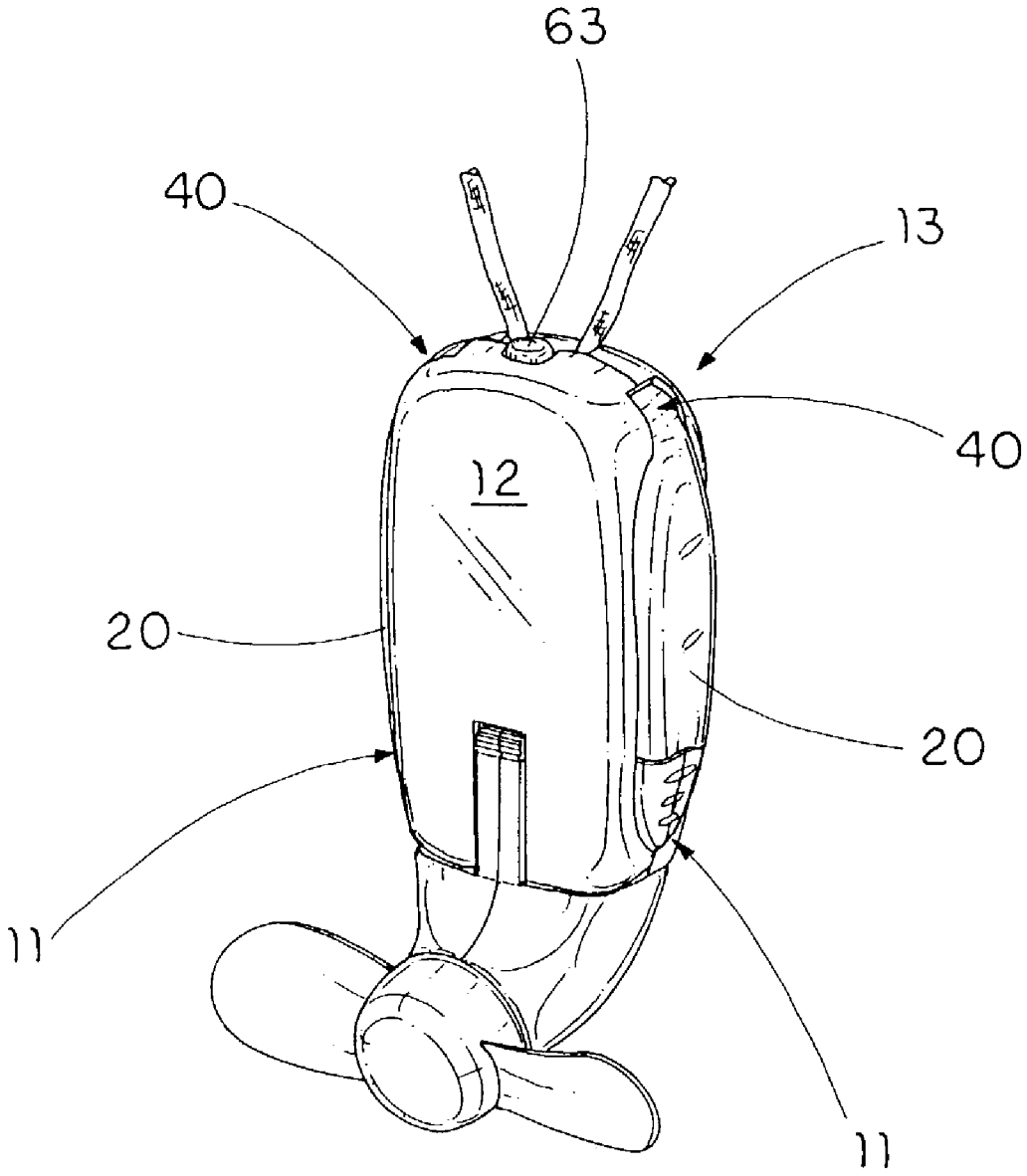
FIG. 3 is a perspective view of the balancer device at a folded position according to the above preferred embodiment of the present invention.

The connecting units 30 respectively comprises two pivot joints 40 provided on the balancing wings 20 for pivotally connecting the inner ends 21 of the balancing wings 20 to the sidewalls 11 of the hanging article 1 respectively. As shown in FIG. 2, each of the pivot joints 40 comprises a pivot axle integrally extended from the inner end 21 of the respective balancing wing 20 arranged for rotatably inserting into a pivot slot 111 formed on the respective sidewall 11 of the hanging article 1, in such a manner that the balancing wings 20 are capable of being folded to a folded position that the balancing wings 20 are folded towards the sidewalls 11 of the hanging article 1, as shown in FIG. 3.

The connecting units 30 further comprises two resilient elements 31 mounted on the balancing wings 20 respectively for providing an urging force against the balancing wings 20 so as to retain the balancing wings 20 at the unfolded position. The resilient elements 31, according to the preferred embodiment, are two coil springs wherein each of the coil springs of the resilient elements 31 has two ends arranged for biasing against the respective balancing wing 20 and the respective sidewall 11 of the hanging article 1 so as to push the balancing wing 20 to pivotally fold apart from the sidewall 11 of the hanging article 1. The resilient elements 31 are preferred mounted in the pivot joints 40 respectively such that the resilient elements 31 are hidden to keep the aesthetic appearance of the hanging article 1.

The balancer device further comprises a locking arrangement 50 for locking the balancing wings 20 at the folded position, wherein the lock arrangement 50 comprises two locking catches 51 adapted for slidably mounting on the sidewalls 11 of the hanging article 1 respectively and two locking latches 52 outwardly extended from inner sides of the balancing wings 20 respectively, wherein each of the locking catches 51 is adapted to move between a locked position and an unlocked position, wherein at the locked position, the balancing wings 20 are arranged for folding on the sidewalls 11 of the hanging article 1 such that the locking latches 52 are engaged with the locking catches 51 so as to lock up the balancing wings 20 at the folded position, and at the unlocked position, the locking catches 51 are moved to release the locking up of the locking latches 52 respectively so that the balancing wings 20 are capable of folding outwardly with respect to the sidewalls 11 of the hanging article 1.

The balancer device further comprises an auto folding arrangement 60 which comprises a driving arm 61 connected between the two locking catches 51, a resilient member 62 having one end biasing against the driving arm 61 to retain the locking catches 51 at the locked position, and an actuator 63 which is extended from the driving arm 61 and is arranged to drive the locking catches 51 from the locked position to the unlocked position though the driving arm 61 so as to release the locking up of the balancing wings 20 at the same time. In other words, the user is able to unlock the balancing wings 20 at the same time by simply actuating the actuator 63 so that the balancing wings 20 are automatically folded from the sidewalls 11 of the hanging article 1 to the unfolded position.

Figure 4:
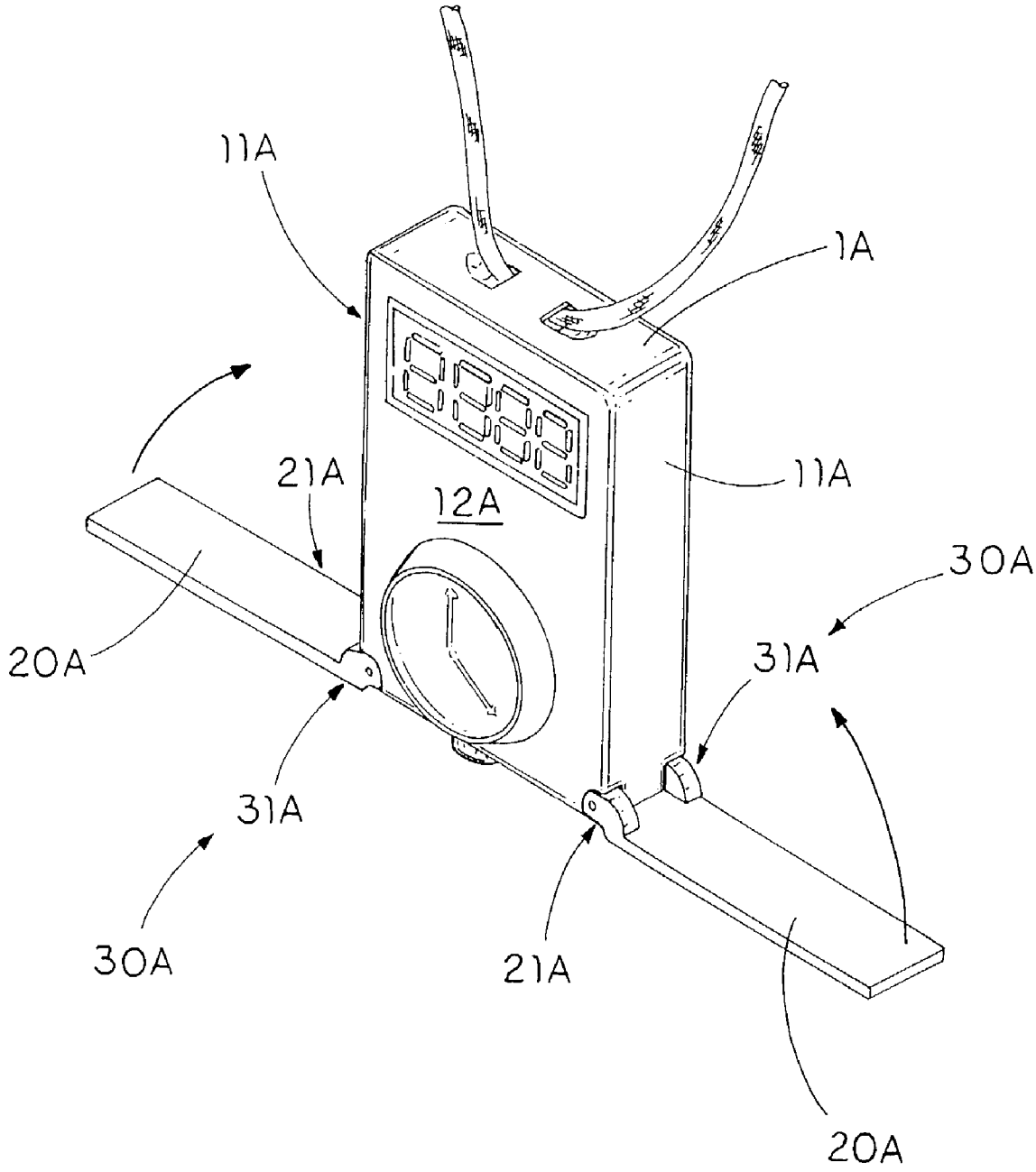
FIG. 4 illustrates a first alternative mode of the balancer device according to the above preferred embodiment of the present invention, illustrating two balancing wings being pivotally folded at two sidewalls of the hanging article.

FIG. 4 illustrates a first alternative mode of the balancer device wherein the hanging article 1A is embodied as a clock timer. The balancer device comprises two balancing wings 20A and two connecting units 30A provided at the inner ends 21A of the balancing wings 20A for connecting the two balancing wings 20A on the hanging article 1A so as to fold the two balancing wings 20A to the unfolded position.

The connecting units 30A respectively comprises two pivot joints 31A provided at the inner ends 21A of the balancing wings 20A respectively for pivotally connecting the balancing wings 20A with the sidewalls 11A of the hanging article 1A, wherein the balancing wings 20A are capable of pivotally folding to the folded position that the balancing wings 20A are folded towards the sidewalls 1A of the hanging article 1A while the balancing wings 20A are held at the unfolded position by friction through the pivot joints 31A.

As shown in FIG. 4, the inner ends of the balancing wings 20A are pivotally connected to the sidewalls 11A of the hanging article 1A at a bottom portion thereof via the pivot joints 31A in such a manner that the balancing wings 20A are pivotally, outwardly, and downwardly folded from the sidewalls 11A of the hanging article 1A. It is worth to mention that when the balancing wings 20A are folded to the unfolded position, the balancing wings 20A embodied as two base stands such that the hanging article 1A is capable of sitting on a flat surface in a stable manner. In other words, when the balancer device of the present invention incorporates with the clock timer of the hanging article 1A, the clock timer of the hanging article 1A is capable of not only stably being placed on the flat surface of a desk as a desk clock with the balancing wings 20A as the base stands but also being hung on the user's body as the supporting surface S while the balancing wings 20A can minimize the spinning movement of the hanging article 1A with respect to the supporting surface S.

Figure 5:
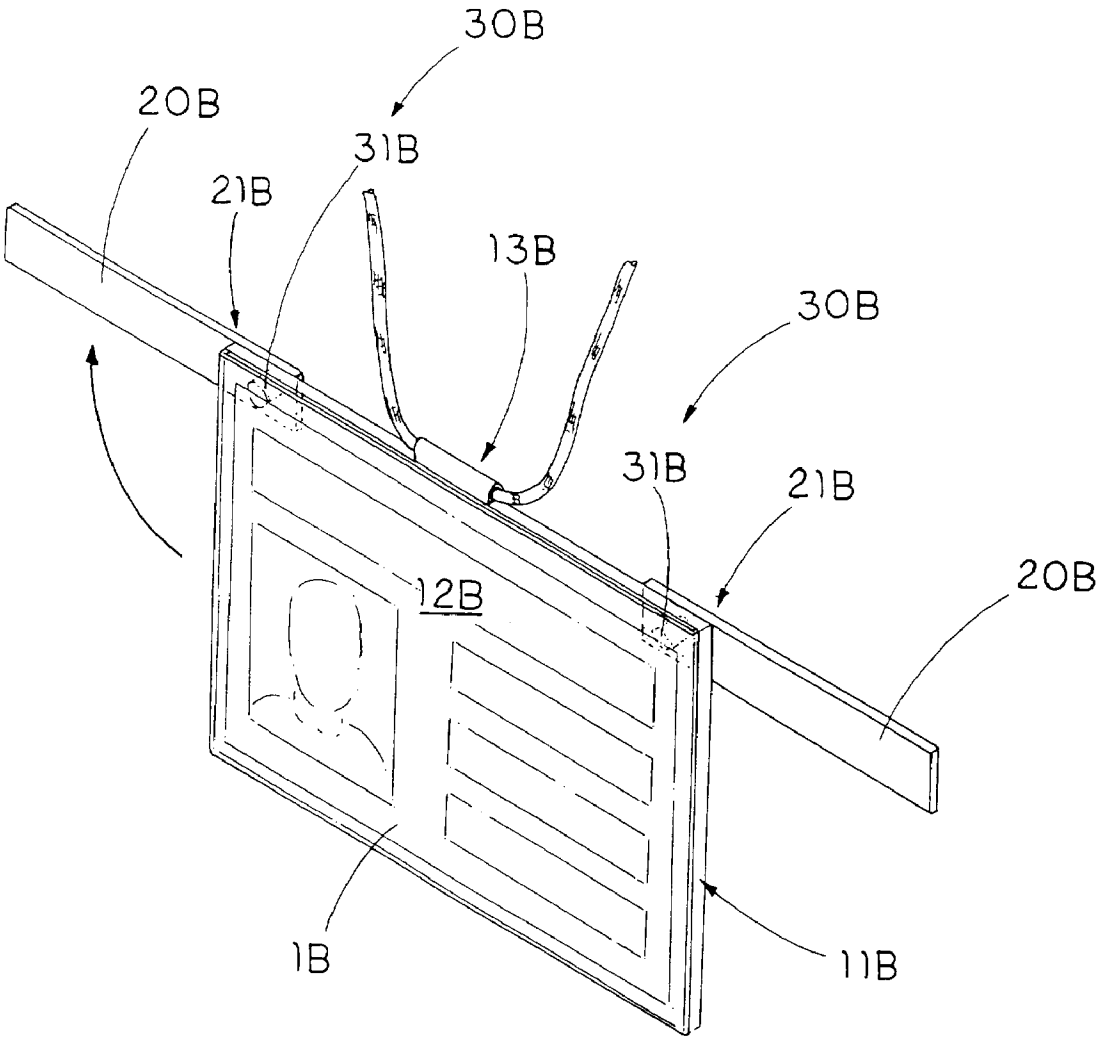
FIG. 5 illustrates a second alternative mode of the balancer device according to the above preferred embodiment of the present invention, illustrating two balancing wings being pivotally folded at a rear side of the hanging article.

FIG. 5 illustrates a second alternative mode of the balancer device wherein the hanging article 1B is embodied as a cardholder. The balancer device comprises two balancing wings 20B and two connecting units 30B provided at the inner ends 21B of the balancing wings 20B for connecting the two balancing wings 20B on the hanging article 1B so as to fold the two balancing wings 20B to the unfolded position.

The connecting units 30B respectively comprises two pivot joints 31B provided at the inner ends 21B of the balancing wings 20B respectively for pivotally connecting the balancing wings 20B with two side portions of the rear side 13B of the hanging article 1B, wherein the balancing wings 20B are capable of pivotally folding to the folded position that the balancing wings 20B are folded on the rear side 13B of the hanging article 1B while the balancing wings 20B are held at the unfolded position by friction through the pivot joints 31B. It is worth to mention that since the thickness of the cardholder of the hanging article 1B is relatively small that the two balancing wings 20B are not able to mount to the sidewalls 11B of the hanging article 1B, the balancing wings 20B can be pivotally mounted on the rear side 13B of the hanging article 1B so as to achieve the same function as mentioned above to prevent the hanging article 1B from spinning around with respect to the supporting surface S.

Figure 6:
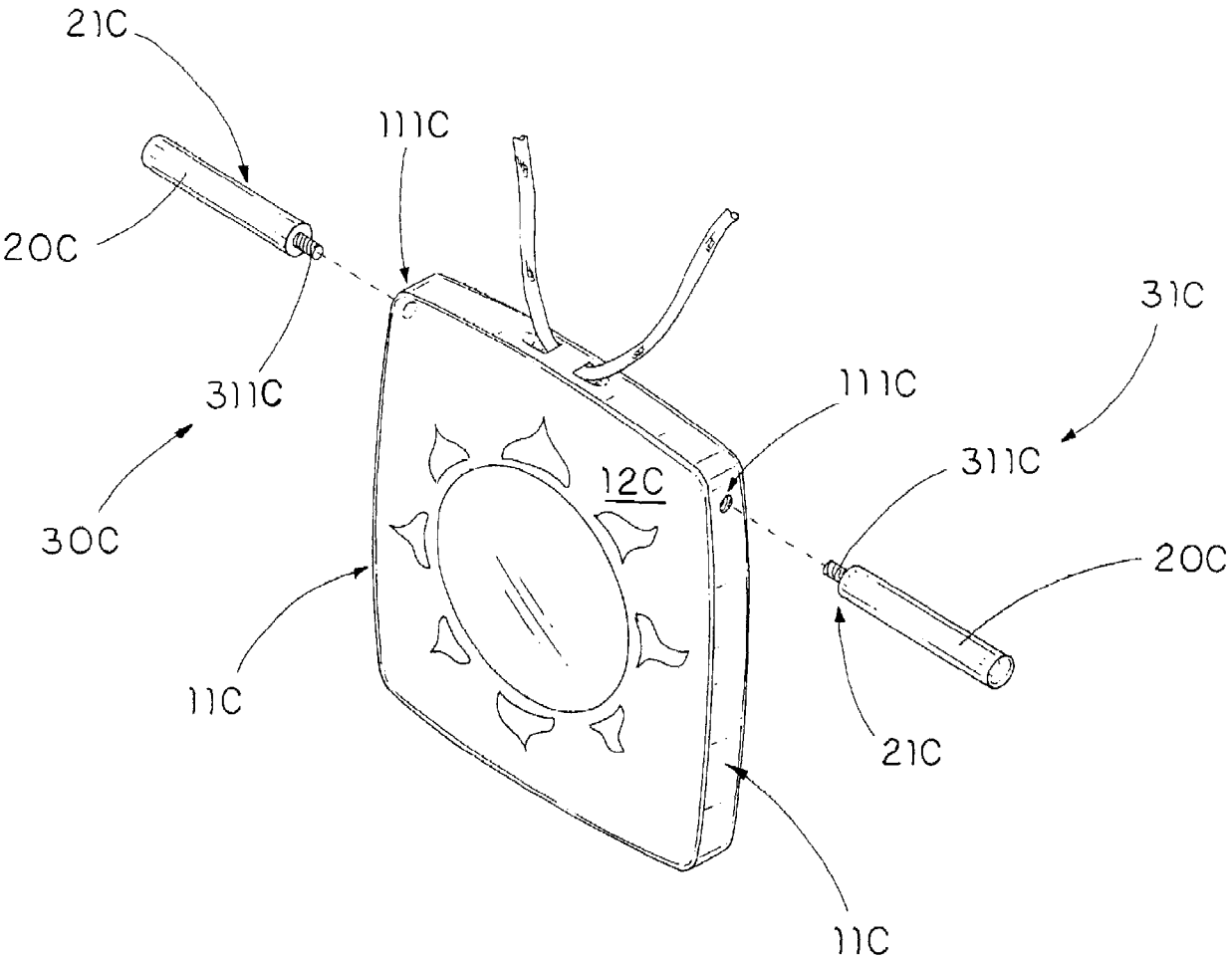
FIG. 6 illustrates a third alternative mode of the balancer device according to the above preferred embodiment of the present invention, illustrating two balancing wings being detachably attached to two sidewalls of the hanging article.

FIG. 6 illustrates a third alternative mode of the balancer device wherein the hanging article 1C is embodied as a logo batch. The balancer device comprises two balancing wings 20C and two connecting units 30C provided at the inner ends 21C of the balancing wings 20C for connecting the two balancing wings 20C on the hanging article 1C so as to fold the two balancing wings 20C to the unfolded position.

The connecting units 30C respectively comprises two detachable joints 31C provided at the inner ends 21C of the balancing wings 20C respectively for detachably connecting the balancing wings 20C with the sidewalls 11C of the hanging article 1C, wherein each of the detachable joints 31C comprises a mounting arm 311C integrally extended from the inner end 21C of the respective balancing wing 20C for slidably inserting into a mounting socket 111C formed on the respective sidewall 11C of the hanging article 1C in a detachably attaching manner in such a manner that the balancing wings 20C are capable of folding to the unfolded position by attaching the balancing wings 20C to the sidewalls 11C of the hanging article 1C respectively and to the folded position by detaching the balancing wings from the sidewalls 11C of the hanging article 1C respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A balancer device for a hanging article having two sidewalls, a front side, and an opposed rear side facing towards a supporting surface, comprising:

two balancing wings each having an inner end;

two connecting units provided at said inner ends of said balancing wings for connecting said two balancing wings on said hanging article, wherein said balancing wings are adapted to be folded at an unfolded position that said two balancing wings are arranged for outwardly extending from said two sidewalls of said hanging article in such a manner that said two balancing wings are capable of blocking a spinning movement of said hanging article with respect to said supporting surface so as to retain said front side of said hanging article in position, wherein said connecting units respectively comprises two pivot joints provided on said balancing wings for pivotally connecting said inner ends of said balancing wings to said sidewalls of said hanging article respectively such that said balancing wings are capable of pivotally folding to a folded position that said balancing wings are pivotally folded towards said sidewalls of said hanging article; and a locking arrangement for locking said balancing wings at the folded position, comprising two locking catches adapted for slidably mounting on said sidewalls of said hanging article respectively, and two locking latches outwardly extended from inner sides of said balancing wings respectively, wherein each of said locking catches is adapted to move between a locked position and an unlocked position, wherein at said locked position, said balancing wings said are arranged for folding on said sidewalls of said hanging article such that said locking latches are engaged with said locking catches so as to lock up said balancing wings at said folded position, and at said unlocked position, said locking catches are moved to release said locking up of said locking latches respectively so that said balancing wings are capable of folding outwardly with respect to said sidewalls of said hanging article.

2. The balancer device, as recited in claim 1, further comprising an auto folding arrangement which comprises a driving arm connected between said two locking catches, a resilient member having one end biasing against said driving arm to retain said locking catches at said locked position, and an actuator which is extended from said driving arm and is arranged to drive said locking catches from said locked position to said unlocked position though said driving arm so as to release said locking up of said balancing wings said at the same time.

3. A balancer device for a hanging article having two sidewalls, a front side, and an opposed rear side facing towards a supporting surface, comprising:

two balancing wings each having an inner end;

two connecting units provided at said inner ends of said balancing wings for connecting said two balancing wings on said hanging article, wherein said balancing wings are adapted to be folded at an unfolded position that said two balancing wings are arranged for outwardly extending from said two sidewalls of said hanging article in such a manner that said two balancing wings are capable of blocking a spinning movement of said hanging article with respect to said supporting surface so as to retain said front side of said hanging article in position, wherein said connecting units respectively comprises two pivot joints provided on said balancing wings for pivotally connecting said inner ends of said balancing wings to said sidewalls of said hanging article respectively such that said balancing wings are capable of pivotally folding to a folded position that said balancing wings are pivotally folded towards said sidewalls of said hanging article, wherein said connecting units further comprises two resilient elements mounted on said balancing wings respectively for providing an urging force against said balancing wings so as to retain said balancing wings at said unfolded position; and a locking arrangement, for locking said balancing wings at the folded position, comprising two locking catches adapted for slidably mounting on said sidewalls of said hanging article respectively, and two locking latches outwardly extended from inner sides of said balancing wings respectively, wherein each of said locking catches is adapted to move between a locked position and an unlocked position, wherein at said locked position, said balancing wings said are arranged for folding on said sidewalls of said hanging article such that said locking latches are engaged with said locking catches so as to lock up said balancing wings at said folded position, and at said unlocked position, said locking catches are moved to release said locking up of said locking latches respectively so that said balancing wings are capable of folding outwardly with respect to said sidewalls of said hanging article.

4. The balancer device, as recited in claim 3, further comprising an auto folding arrangement which comprises a driving arm connected between said two locking catches, a resilient member having one end biasing against said driving arm to retain said locking catches at said locked position, and an actuator which is extended from said driving arm and is arranged to drive said locking catches from said locked position to said unlocked position though said driving arm so as to release said locking up of said balancing wings said at the same time.

5. A balancer device for a hanging article having two sidewalls, a front side, and an opposed rear side facing towards a supporting surface, comprising:

two balancing wings each having an inner end;

two connecting units provided at said inner ends of said balancing wings for connecting said two balancing wings on said hanging article, wherein said balancing wings are adapted to be folded at an unfolded position that said two balancing wings are arranged for outwardly extending from said two sidewalls of said hanging article in such a manner that said two balancing wings are capable of blocking a spinning movement of said hanging article with respect to said supporting surface so as to retain said front side of said hanging article in position, wherein said connecting units respectively comprises two pivot joints provided on said balancing wings for pivotally connecting said inner ends of said balancing wings to said sidewalls of said hanging article respectively such that said balancing wings are capable of pivotally folding to a folded position that said balancing wings are pivotally folded towards said sidewalls of said hanging article, wherein said connecting units further comprises two resilient elements mounted on said balancing wings respectively for providing an urging force against said balancing wings so as to retain said balancing wings at said unfolded position, wherein said resilient elements are two coil springs received in said pivot joints respectively for providing said urging force against said balancing wings; and a locking arrangement, for locking said balancing wings at the folded position, comprising two locking catches adapted for slidably mounting on said sidewalls of said hanging article respectively, and two locking latches outwardly extended from inner sides of said balancing wings respectively, wherein each of said locking catches is adapted to move between a locked position and an unlocked position, wherein at said locked position, said balancing wings said are arranged for folding on said sidewalls of said hanging article such that said locking latches are engaged with said locking catches so as to lock up said balancing wings at said folded position, and at said unlocked position, said locking catches are moved to release said locking up of said locking latches respectively so that said balancing wings are capable of folding outwardly with respect to said sidewalls of said hanging article.

6. The balancer device, as recited in claim 5, further comprising an auto folding arrangement which comprises a driving arm connected between said two locking catches, a resilient member having one end biasing against said driving arm to retain said locking catches at said locked position, and an actuator which is extended from said driving arm and is arranged to drive said locking catches from said locked position to said unlocked position though said driving arm so as to release said locking up of said balancing wings said at the same time.

7. The balancer device, as recited in claim 5, wherein each of said balancing wings is arranged for being shaped corresponding to said respective sidewall of said hanging article, each of said balancing wings having a width being not substantially exceed a width of said respective sidewall of said hanging article, and each of said balancing wings having a length being not substantially exceed a height of said respective sidewall of said hanging article.

8. The balancer device, as recited in claim 6, wherein each of said balancing wings is arranged for being shaped corresponding to said respective sidewall of said hanging article, each of said balancing wings having a width being not substantially exceed a width of said respective sidewall of said hanging article, and each of said balancing wings having a length being not substantially exceed a height of said respective sidewall of said hanging article.

* * * * *